US011199047B1

(12) United States Patent
Chapman

(10) Patent No.: US 11,199,047 B1
(45) Date of Patent: Dec. 14, 2021

(54) SAFETY GUARD FOR DOOR GAPS

(71) Applicant: Adam Curry Chapman, Chicago, IL (US)

(72) Inventor: Adam Curry Chapman, Chicago, IL (US)

( * ) Notice: Subject to any disclaimer, the term of this patent is extended or adjusted under 35 U.S.C. 154(b) by 144 days.

(21) Appl. No.: 16/851,205

(22) Filed: Apr. 17, 2020

(51) Int. Cl.
*E05D 11/00* (2006.01)
*E06B 7/36* (2006.01)

(52) U.S. Cl.
CPC ..... *E06B 7/367* (2013.01); *E05D 11/0054* (2013.01); *E05Y 2900/132* (2013.01)

(58) Field of Classification Search
CPC ..... E05C 17/00; E05C 17/46; E05C 17/54; E05C 17/44; E05C 17/025; E05F 5/02; E05F 5/04; E05F 5/06; E05F 5/00; E05F 2005/046; E05Y 2900/132; E05Y 2201/212; E05Y 2201/224; Y10T 292/71; Y10T 292/73; E05D 11/06; E05D 11/0054; E05D 2011/0063; E05D 2011/0072; E06B 7/367; E06B 7/36; E06B 17/362; E06B 2007/365
See application file for complete search history.

(56) References Cited

U.S. PATENT DOCUMENTS 2,681,480 A * 6/1954 Dixon, Sr. ..... E06B 7/367 49/383
3,137,042 A * 6/1964 Levenberg ..... E06B 7/367 49/384
4,106,238 A * 8/1978 Bonello ..... E05D 7/02 16/243
4,845,892 A * 7/1989 Pinto ..... E06B 7/16 49/383
6,134,839 A 10/2000 Johansson
6,434,888 B1 * 8/2002 Shaw ..... E06B 7/367 16/258
7,861,465 B1 * 1/2011 Christ ..... E06B 7/367 49/506
9,328,546 B1 * 5/2016 Davis ..... E06B 7/362
2004/0107647 A1 * 6/2004 Salzman ..... E06B 7/367 49/462
2006/0026793 A1 * 2/2006 Li ..... E06B 7/367 16/82

(Continued)

FOREIGN PATENT DOCUMENTS

DE 2518743 A1 * 11/1976 ..... E05D 7/009
DE 202009014642 U1 * 1/2010 ..... E05D 11/0054

(Continued)

*Primary Examiner* — Chuck Y Mah
(74) *Attorney, Agent, or Firm* — Donald J. Ersler

(57) ABSTRACT

A safety guard for door gaps preferably includes a telescoping tube cover, a compression spring, a top bushing, a top hinge tube and a bottom pin bushing. The telescoping tube cover includes a first tube and a second tube. The compression spring is inserted into first tube and the second tube is inserted into the first tube. The top bushing is inserted into a top of the second tube. The second bottom bushing is inserted into a bottom of the first tube. A second embodiment of the safety guard includes the telescoping tube cover, the top bushing, the top hinge tube, the bottom pin bushing and a fastener. A third embodiment of the door safety guard preferably includes a safety tube, a top pin bushing, the bottom pin bushing and an extra length hinge pin.

11 Claims, 7 Drawing Sheets

(56) References Cited

U.S. PATENT DOCUMENTS

| | | | | |
|---|---|---|---|---|
| 2011/0214355 | A1* | 9/2011 | Kim | E05D 11/0054 49/383 |
| 2016/0245015 | A1* | 8/2016 | Davis | E06B 7/367 |
| 2018/0274287 | A1* | 9/2018 | Dintheer | E06B 7/2305 |
| 2019/0383075 | A1* | 12/2019 | Shin | E06B 7/362 |

FOREIGN PATENT DOCUMENTS

| | | | | |
|---|---|---|---|---|
| EP | 3315703 | B1 * | 6/2019 | E05C 17/025 |
| EP | 3767067 | A1 * | 1/2021 | E06B 7/367 |
| KR | 101353483 | B1 * | 1/2014 | E05D 5/065 |
| WO | WO-2011082133 | A2 * | 7/2011 | E06B 7/367 |

* cited by examiner

SAFETY GUARD FOR DOOR GAPS

BACKGROUND OF THE INVENTION

1. Field of the Invention

The present invention relates generally to rooms and more specifically to a safety guard for door gaps, which prevents children and others from inserting their fingers into door gaps when the door is opened or closed.

2. Discussion of the Prior Art

Child-proof door jamb covers have been provided in the past for preventing the pinching of children's fingers between doors and door jambs as doors open and close. Many village, city, and county ordinances in communities in the United States require such door jamb covers to ensure the safety of our children. Unfortunately, existing door safety solutions require full door replacement with new continuous hinges, or drilling/screwing into existing doors, and/or using strong adhesives to attach products to existing doors and associated jambs. Existing door safety solutions also often interfere with the natural swing of a door, sometimes causing doors to have an unwanted open or closed bias.

Landlords have lease provisions that prohibit damage to the leased property by the tenant and thus prevent invasive door add-on products that require drilled-in screws and/or damage-causing strong adhesives. Other building codes often restrict adding anything additional to the face of the swinging door itself. Finally, many landlords want doors and door frames to remain in an easily paintable state at all times. To date, it is believed that no hinge-pin-side (rear of door) child-safety finger guard mounting system has been introduced that is sturdy, easy to install, removable, requires no screws (nor screwdrivers) nor damaging adhesives, while also minimizing contact of any kind with the actual door or the door jamb trim. The existence of a fast, simple and effective product that incorporates a removable, no-tools-required, non-door-touching, non-door-jamb-touching mounting approach that relies on the presence and natural location of the existing door hinges will result in a vast number of installed child finger guards, greatly improving the safety of many.

Hinge pin brackets have been provided in the past, such as that shown in the Buckelew; U.S. Pat. No. 6,658,696, and also in U.S. Pat. No. 1,208,986A ("Combination Hinge and Rack"). These hinge-pin-based products provide no protective coverage of the dangerous exposed gap between the door and the door jamb. They provide no protective coverage of the door hinge gap, nor a method for providing constant door hinge gap coverage through all possible door open and closed positions. What is needed is a removable back-of-the-door mounting system, which allows the attachment of products, vertically, between the existing hinges, along the back side of the door (hinge pin side of door), while covering the dangerous door/door jamb gap area, which is vertically offset from the existing door hinges on the back side of the door, through all possible door open and closed positions.

Patent US20090282741A1: "Door Gap Protector" describes a product that mounts to the top hinge of a door and vaguely talks about an accordion cover with a bias to always expand, thus always keeping the gap covered. A downside of this design is that this expanding pressure causes the door to want to close when it is open, and the cover plate is in contact with the door and the door jamb, thus making is difficult to paint the door and the door jamb while the product is installed. There are five U.S. Pat. Nos. 6,134,839; 5,765,311; 5,778,601; 6,434,888, and 8,505,168 that show mounted brackets for attaching add-ons to doors, and these require a screwdriver, screws and, in some cases, a drill, to be used in attaching an elongated protective plate designed to cover the dangerous gap between the door and the door jamb. Unfortunately, the need for a screwdriver and screws is a complexity that deters many people from using these solutions. For one, landlords have lease provisions that prohibit damage and alterations to leased property by tenants. Secondly, installing screws into the door and door jamb requires more physical strength and know-how than many people possess. Finally, screw sizes vary and often a correctly-sized screwdriver is not readily available. These obstacles collectively prevent the installation of products that would protect building owners' and tenants' children as well as their guests' children. An improved child-safety door guard design should enable mounting an elongated, child-protecting, cylindrical tube to the back of the door, by using a mounting assembly that does not damage the door, and does not come into direct contact with the door.

U.S. Pat. No. 10,138,673B1 teaches a non-invasive, no-tools-necessary, no-holes-drilled, no-adhesives method of covering the dangerous gaps on the front and the rear of the door, but the hardware protrudes to be visible on the front side of the door, even in the closed position, and it involves door gap coverings that come into direct contact with the paintable surface of the door and the paintable surface of the door jamb, which is not to the liking of some landlords or tenants. An improved design should enable a removable back-of-the-door-only mounting system, that does not touch the door or door jamb directly, which allows the attachment of products, vertically, between the existing hinges, along the back side of the door (hinge pin side of door), while covering the dangerous door/door jamb gap area, which is vertically offset from the existing door hinges on the back side of the door, through all possible door open and closed positions.

To overcome the identified issues of existing products, the present invention provides a new method for improving home safety and/or home livability by allowing the easy installation of useful add-on products to the back side of hinged-doors (the side where the hinge-pins are located). The present invention involves a mounting system for a hinged door, allowing finger guards (and other add-ons) to be affixed to the back side of a door in a manner that requires no drilling of holes, few installation parts and no damaging paint-stripping adhesives. The mounting system is also notable for being easily removable, returning the door to its original condition once removed. The mounting system is also notable for its lack of interference with, and lack of contact with, the existing door jamb trim and the door, which allows both the door and door frame trim to be painted, while the mounting system is in place.

Accordingly, there is a clearly felt need in the art for a safety guard for door gaps, which prevents children and others from inserting their fingers into door gaps when the door is opened or closed; shows no visible hardware on a front of the door when the door is closed; may be installed by construction workers at the early states of construction; and may be removed leaving all door surfaces, door frame surfaces, and door hardware in their original conditions.

SUMMARY OF THE INVENTION

The present invention provides a safety guard for door gaps, which may be removed leaving all door surfaces, door frame surfaces, and door hardware in their original conditions. The safety guard for door gaps (door safety guard) preferably includes a telescoping tube cover, a compression spring, a top bushing, a top hinge tube and a bottom pin bushing. The telescoping tube cover includes a first tube and a second tube. An inner perimeter of the first tube is sized to receive an outer perimeter of the second tube. The bottom pin bushing is inserted into a bottom of the first tube. A bore formed through the bottom pin bushing is sized to receive a head of a hinge pin in a bottom hinge. The compression spring is inserted into first tube and the second tube is inserted into the first tube. The top bushing is inserted into a top of the second tube. The top hinge tube is slipped over a bottom of a hinge pin enclosure in a top hinge. The bottom bore of the bottom bushing is pushed over the head of the hinge pin of the bottom hinge. The second tube is pushed into the first tube, such that a bottom of the top hinge tube may be inserted into a top bore in the top bushing. The compression spring holds the safety guard in place to protect the door gap from crushing fingers and the like.

A second embodiment of the safety guard includes the first tube, the second tube, the top bushing, the top hinge tube and the bottom pin bushing. The bottom pin bushing is inserted into the bottom of the first tube. The top bushing is inserted into a top of the second tube. The second tube is inserted into the first tube. The top hinge tube is slipped over a bottom of a hinge pin enclosure in a top hinge. The bottom bore of the bottom bushing is pushed over the head of the hinge pin of the bottom hinge. The second tube is pushed into the first tube and then extended such that a bottom of the top hinge tube may be inserted into a top bore in the top bushing. The first and second tubes are extended outward from each other. A fastener or the like is then inserted through the first and second tubes to prevent axial movement there between.

A third embodiment of the door safety guard preferably includes a safety tube, a top pin bushing, the bottom pin bushing and an extra length hinge pin. The top pin bushing is inserted into a top of the safety tube and the bottom pin bushing is inserted into a bottom of the safety tube. The safety tube is cut to a length between a top of the bottom hinge and a bottom of the top hinge. The bottom pin bushing is then inserted into a bottom of the safety tube and the top pin bushing is inserted into a top of the safety tube. The normal hinge pin is removed and the extra length hinge pin is inserted into the top hinge, while the safety tube is located in place.

Accordingly, it is an object of the present invention to provide a door safety guard, which prevents children and others from inserting their fingers into door gaps when the door is opened or closed.

It is further object of the present invention to provide a door safety guard, which shows no visible hardware on a front of the door when the door is closed.

Finally, it is another object of the present invention to provide a door safety guard, which may be removed, leaving all door surfaces, door frame surfaces, and door hardware in their original condition.

These and additional objects, advantages, features and benefits of the present invention will become apparent from the following specification.

DETAILED DESCRIPTION OF THE PREFERRED EMBODIMENTS

Figure 1:
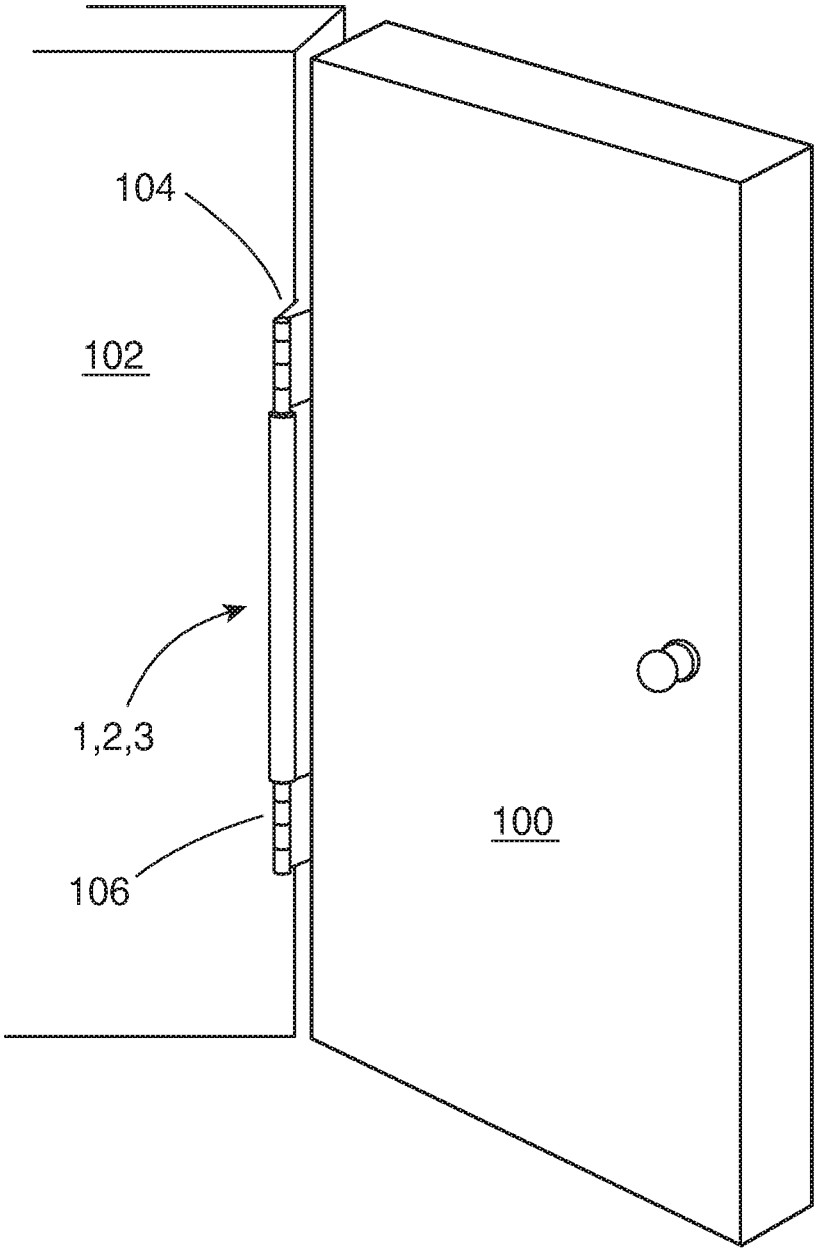
FIG. 1 is a perspective view of a door safety guard installed between top and bottom hinges of a door in accordance with the present invention.
Figure 2:
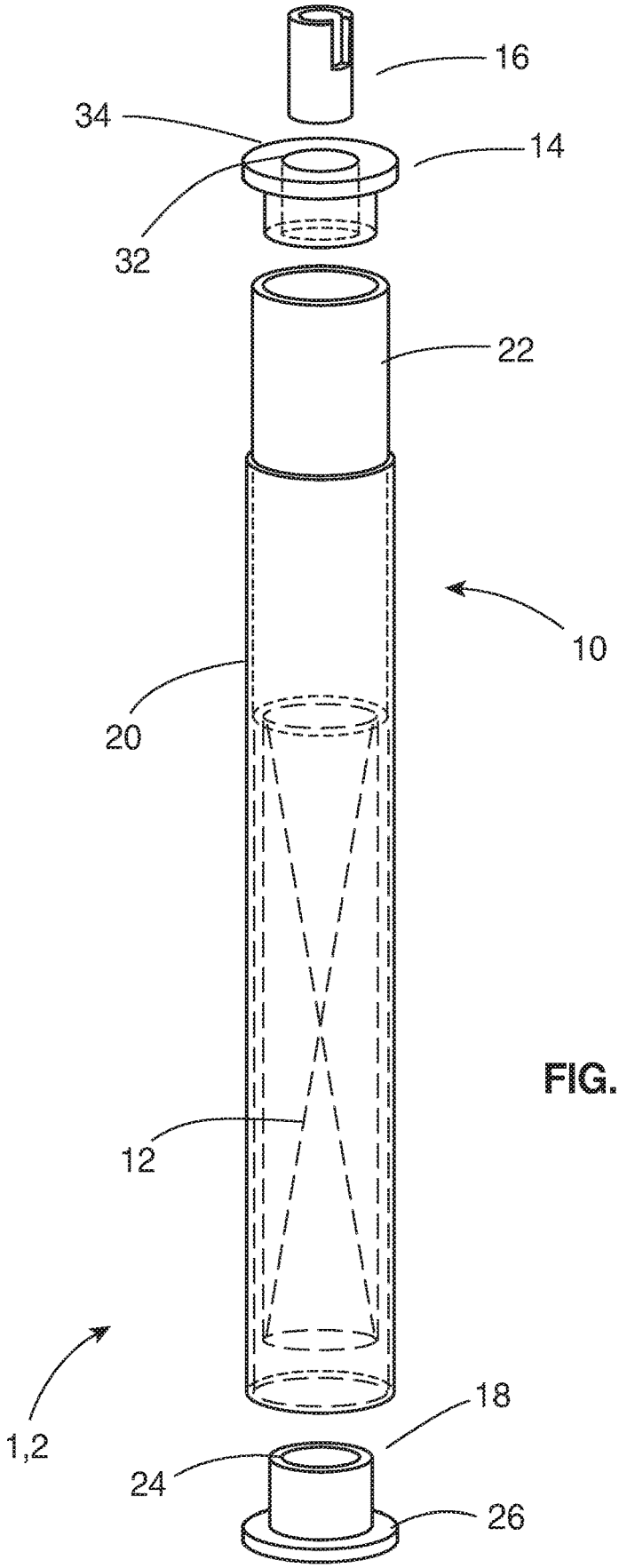
FIG. 2 is a partially exploded perspective view of a door safety guard in accordance with the present invention.

With reference now to the drawings, and particularly to FIG. 1, a door safety guard 1, 2, 3 is installed between a top hinge 104 and a bottom hinge 106, which are retained between a door 100 and a wall 102. With reference to FIG. 2, the door safety guard 1 preferably includes a telescoping tube cover 10, a compression spring 12, a top bushing 14, a top hinge tube 16 and a bottom pin bushing 18. The telescoping tube cover 10 includes a first tube 20 and a second tube 22. An inner perimeter of the first tube 20 is sized to receive an outer perimeter of the second tube 22. The bottom pin bushing 18 is preferably retained in a bottom of the first tube 22 with a bonding agent, a press fit, sonic welding or any suitable retention method. However, the bottom pin bushing 18 may also have a slip fit with any inner perimeter of the first tube 20. A head bore 24 formed through the bottom pin bushing 18 is sized to receive a head of a hinge pin in the bottom hinge 106. The bottom pin bushing 18 preferably includes a flange 26 extending outward from a bottom of an outer perimeter of the pin bushing 18. The compression spring 12 is inserted into a bottom of the first tube 20 and the second tube 22 is inserted into a top of the first tube 20. The bottom pin bushing 18 is then secured in the bottom of the first tube 20. The top bushing 14 is inserted into an inner perimeter of the second tube 22.

Figure 5:
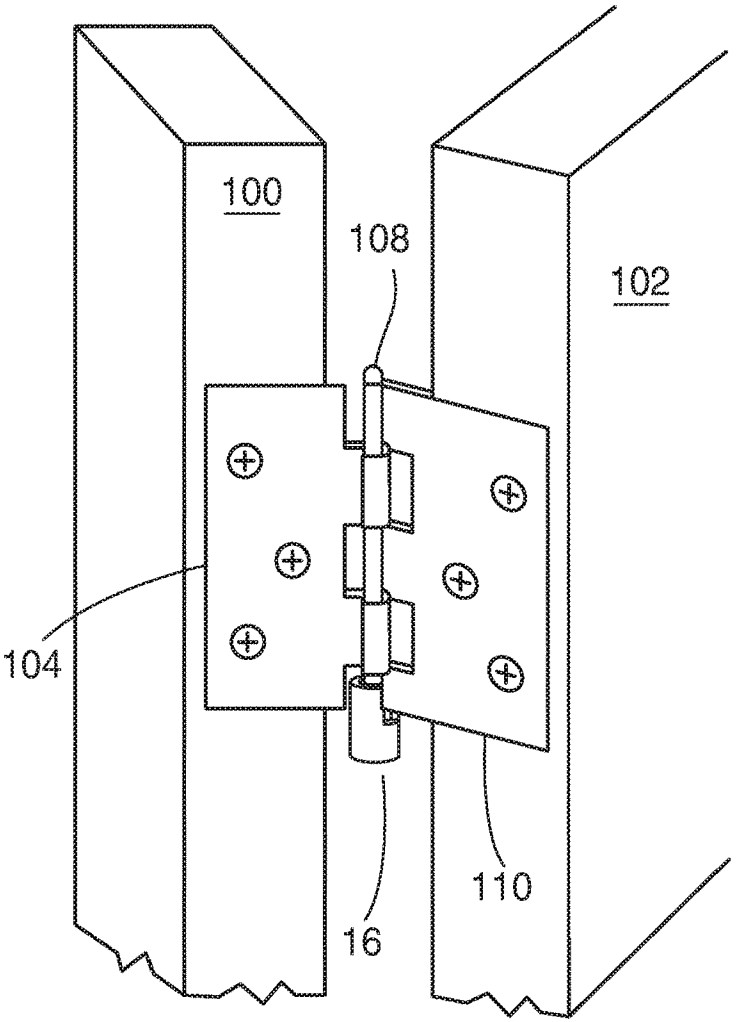
FIG. 5 is a perspective view of a top hinge tube secured to a hinge pin enclosure of a door safety guard in accordance with the present invention.
Figure 4:
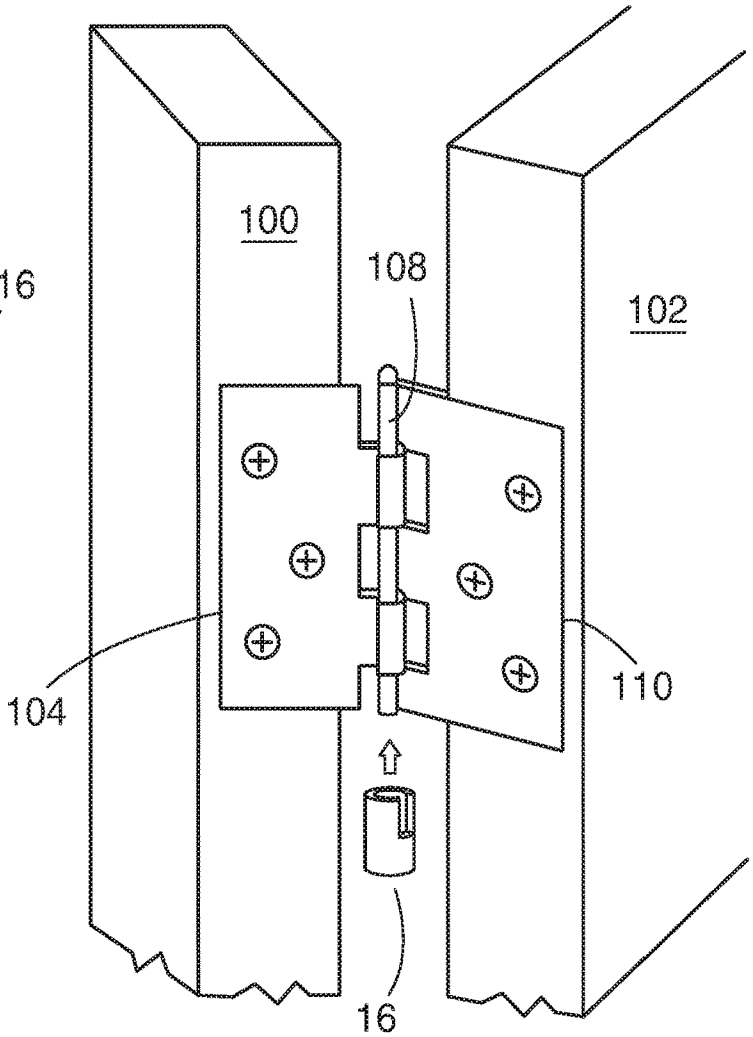
FIG. 4 is a partial exploded perspective view of a top hinge tube before attachment to a hinge pin enclosure of a hinge of a door of a door safety guard in accordance with the present invention.
Figure 3:
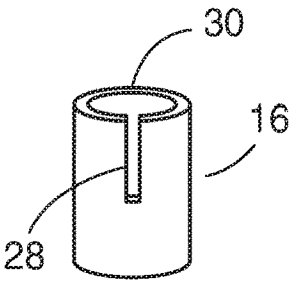
FIG. 3 is an enlarged perspective view of a top hinge tube of a door safety guard in accordance with the present invention.
Figure 3A:
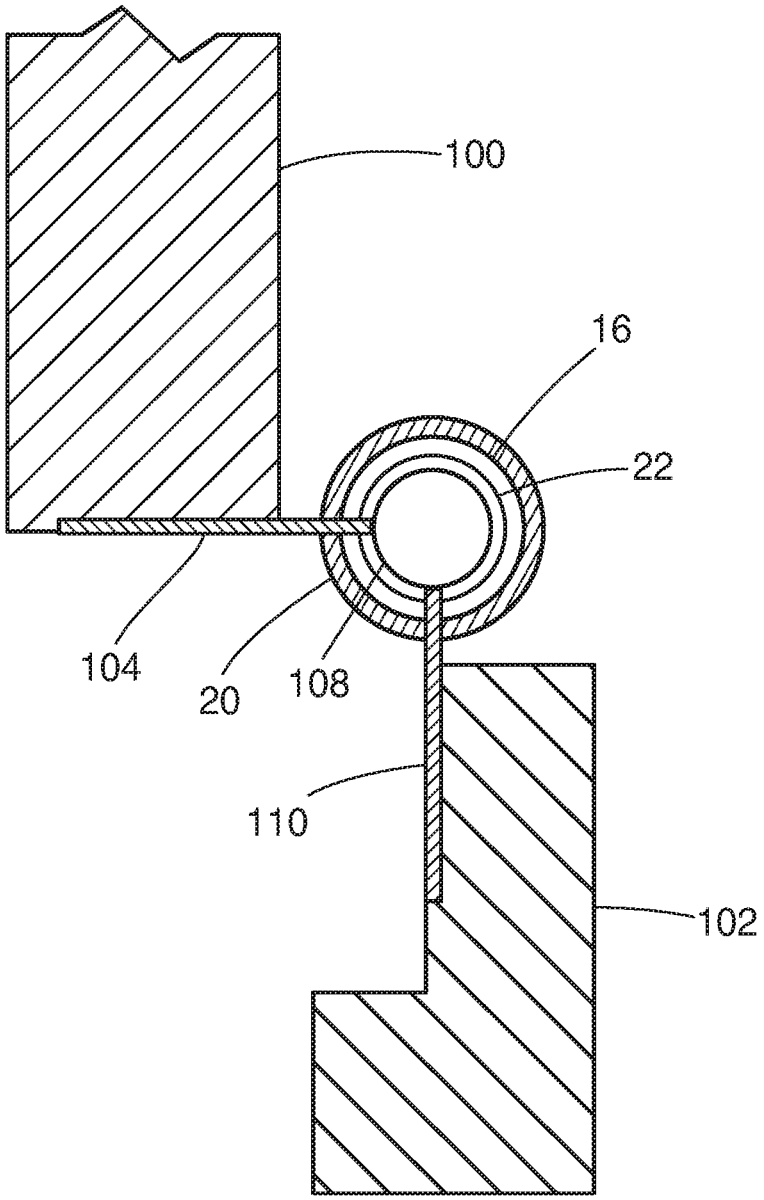
FIG. 3*a* is an enlarged cross sectional view of a top hinge tube cut through FIG. 1 and retained on a hinge pin enclosure and the top hinge tube retained in a second tube of a door safety guard in accordance with the present invention.

With reference to FIGS. 3-5, the top hinge tube 16 includes a plate slit 28. The top hinge tube 16 also includes an inner diameter 30, which is sized to receive a top hinge pin enclosure 108 of the top hinge 104. The top hinge tube 16 is slipped over a bottom of the top hinge pin enclosure 108 in the top hinge 104. The top hinge tube 16 inner diameter is sized to receive the outer diameter of the hinge pin enclosure 108, upon which it is affixed. Further, a wall thickness of the top hinge tube 16 is sized to not interfere with the rotating parts of the top hinge 104. The plate slit 28 is sized to receive a thickness of a hinge plate 110. The bottom bore 24 of the bottom bushing 18 is pushed over a head of a hinge pin of the bottom hinge 106. The top bushing 14 preferably includes a tube bore 32 and a top flange 34. The tube bore 32 is sized to receive the top hinge tube 16. The top flange 34 extends outward from a top of an outer perimeter of the top bushing 14. The top bushing 14 is inserted into a top of the second tube 22. The second tube 22 is pushed down into the first tube 20, such that a bottom of the top hinge tube 16 may be inserted into the top bore 32 in the top bushing 14. The compression spring 12 forces the telescoping tube cover 10 to expand against the top and bottom hinges 104, 106 to protect the door gap from crushing fingers and the like.

Figure 6:
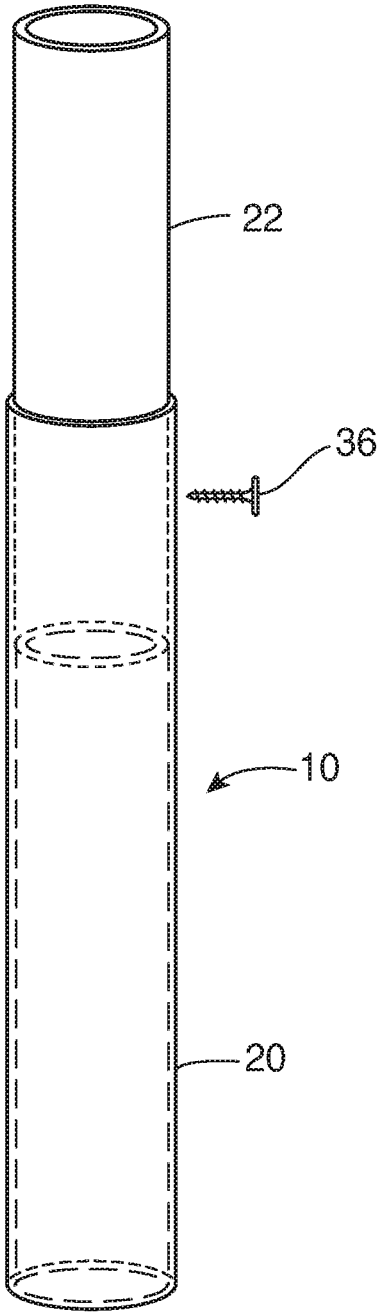
FIG. 6 is a partially exploded perspective view of a telescoping door cover and an anchoring screw of a second embodiment of a door safety guard in accordance with the present invention.
Figure 7:
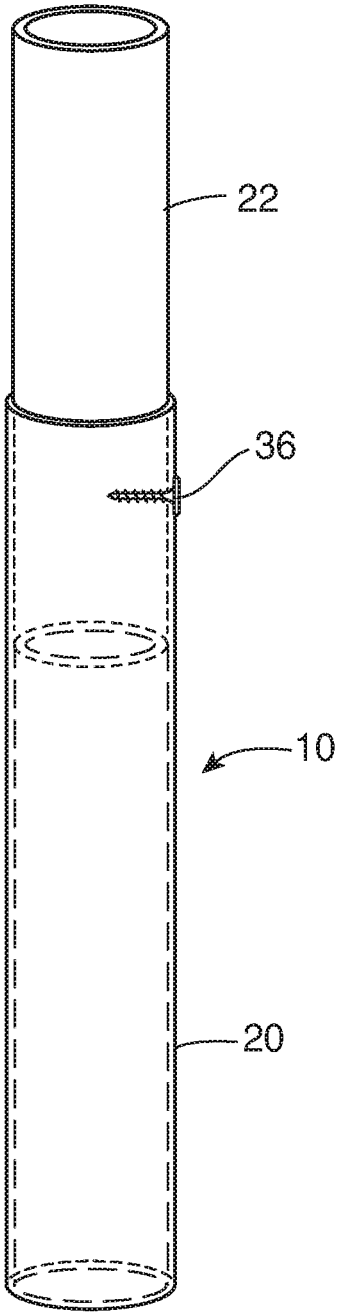
FIG. 7 is a perspective view of a telescoping door cover with an anchoring screw engaged therewith of a second embodiment of a door safety guard in accordance with the present invention.

A second embodiment of the door safety guard 2 includes the telescoping tube cover 10, the top bushing 14 and the bottom pin bushing 18. The bottom pin bushing 18 is inserted into the bottom of the first tube 20. The top bushing 14 is inserted into a top of the second tube 22. The top hinge tube 16 is slipped over a bottom of the top hinge pin enclosure 108 in the top hinge 104. The bottom bore 24 of the bottom bushing 18 is pushed over the head of the hinge pin of the bottom hinge 106. The second tube 22 is extended such that a bottom of the top hinge tube 16 is inserted into the top bore 34 in the top bushing 14. With reference to FIGS. 5-6, a fastener 36 or the like is inserted through the first and second tubes 20, 22 to prevent axial movement there between, instead of using the compression spring 12.

Figure 8:
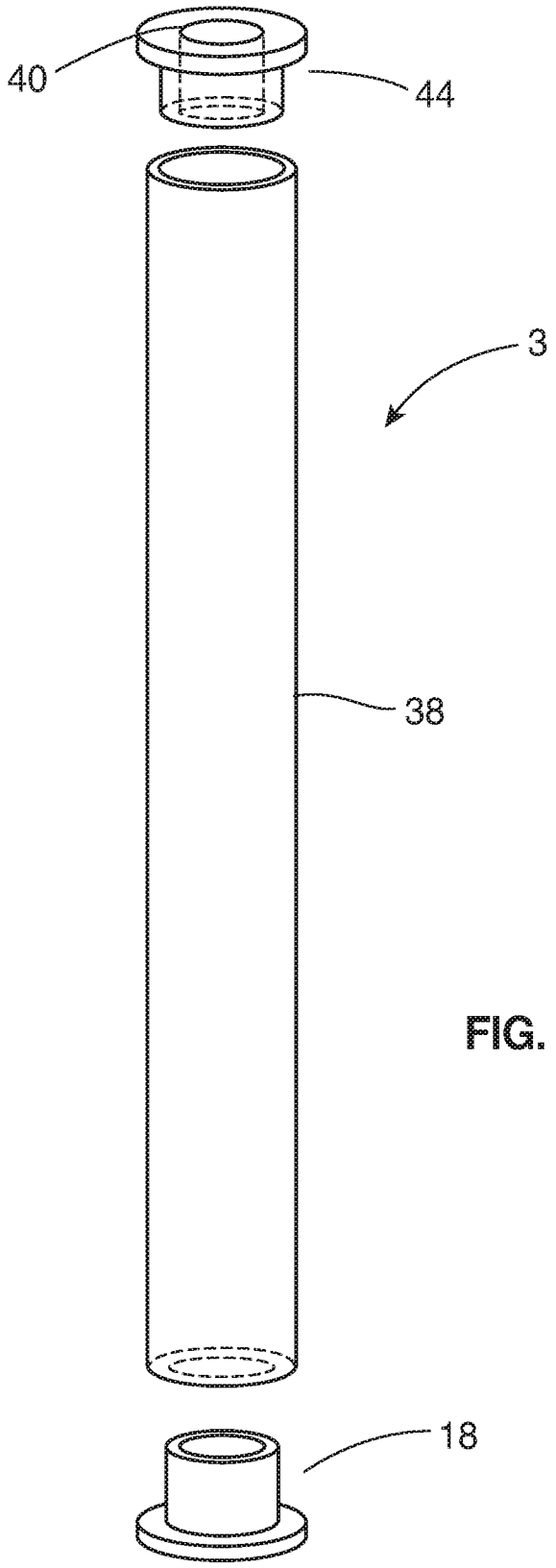
FIG. 8 is an exploded perspective view of a third embodiment of a door safety guard in accordance with the present invention.
Figure 9:
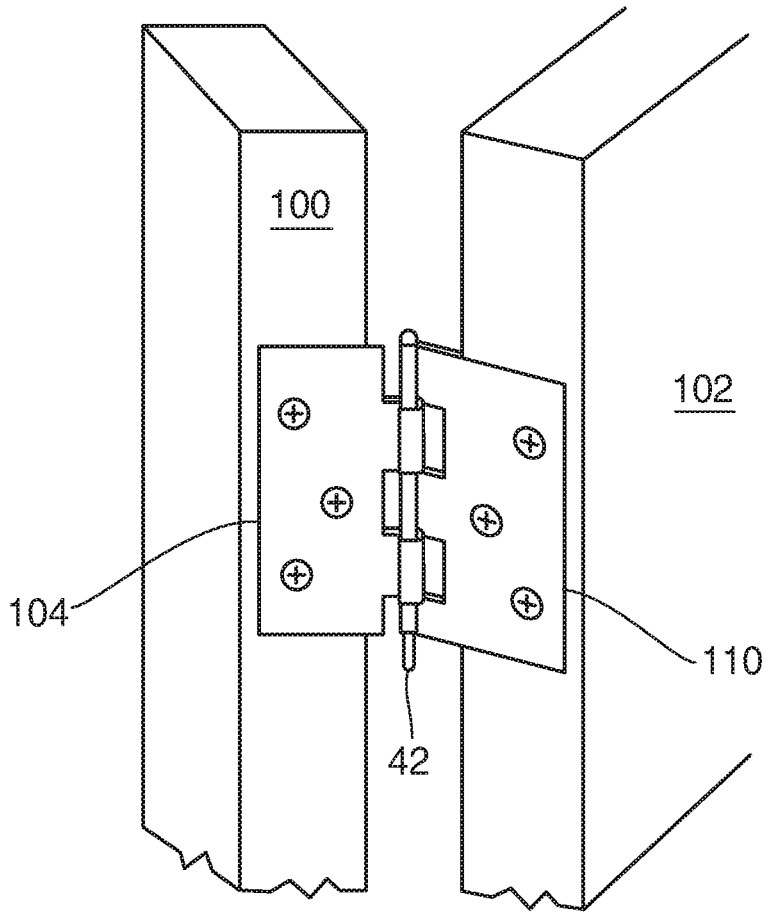
FIG. 9 is a perspective view of an extra length hinge pin inserted into a top hinge of a third embodiment of a telescoping door cover in accordance with the present invention.

With reference to FIGS. 8-9, a third embodiment of the safety guard 3 preferably includes a safety tube 38, the top pin bushing 40, the bottom pin bushing 18 and an extra length hinge pin 42. The top pin bushing 40 includes a pin bore 44. The top pin bushing 44 is inserted into a top of the safety tube 38 and the bottom pin bushing 18 is inserted into a bottom of the safety tube 38. The safety tube 38 is cut to a length, which is the same as a measurement between a top of the bottom hinge 106 and a bottom of the top hinge 104, minus a thickness of the bushing flanges 18, 40. The bottom pin bushing 18 is then inserted into a bottom of the safety tube 38 and the top pin bushing 44 is inserted into a top of the safety tube 38. A normal hinge pin is removed from the top hinge 104 and the extra length hinge pin 42 is inserted into the top hinge 106, while an axis of the safety tube 38 is aligned with the hinge pins of the top and bottom hinges 104, 106. The third embodiment of the door safety guard 3 is now retained in place.

FIG. 2 depicts the common scenario of a protruding hinge pin head being present on the top-side of the lower hinge, but no protruding hinge pin head being present on the bottom-side of the upper hinge. However, on some door systems, the upper hinge bottom-side might have a protruding hinge pin head, and the lower hinge top-side might not, thus inverting the FIG. 2 embodiment as described. The same outcome is achieved. Or, perhaps neither hinge has a protruding hinge pin head, requiring two "hinge tube" adaptors (instead of one), one "hinge tube" adaptor for attaching to the bottom of the hinge pin enclosure of the top hinge, and another "hinge tube" adaptor for attaching to the top of the hinge pin enclosure of the lower hinge. The same outcome is achieved. All combinations of hinge pin head scenarios are intended to be generally handled by the FIG. 2 embodiment as described.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A safety guard for door gaps, comprising:

a telescoping tube cover includes a first tube and a second tube, said first tube is sized to receive said second tube;

a compression spring is retained in said first tube, said compression spring biases a top of said second tube away from a bottom of said first tube;

a top hinge tube includes an inner diameter which is sized to receive a bottom end of a hinge pin enclosure of a top hinge;

a top bushing is retained in a top of said second tube, said top bushing includes a pin bore to receive said top hinge tube; and a bottom pin bushing is retained in a bottom of said first tube, said bottom pin bushing includes an inner diameter which is sized to receive a head of a hinge pin of a bottom hinge.

2. The safety guard for door gaps of claim 1 wherein:

said top bushing includes a top flange extending outward from an outer perimeter at a top thereof.

3. The safety guard for door gaps of claim 1 wherein:

said bottom bushing includes a bottom flange extending outward from an outer perimeter at a bottom thereof.

4. The safety guard for door gaps of claim 1 wherein:

a plate slit is formed in an end of said top hinge tube to receive a thickness of a hinge plate of said top hinge.

5. A safety guard for door gaps, comprising:

a telescoping tube cover includes a first tube and a second tube, said first tube is sized to receive said second tube;

a top hinge tube includes an inner diameter which is sized to receive a bottom end of a hinge pin enclosure of a top hinge;

a top bushing is retained in a top of said second tube, said top bushing includes a pin bore to receive said top hinge tube;

a bottom pin bushing is retained in a bottom of said first tube, said bottom pin bushing includes an inner diameter which is sized to receive a head of a hinge pin of a bottom hinge; and a fastener for insertion through said first and second tubes, wherein said top bushing is in contact with a top hinge, said bottom bushing is in contact with a bottom hinge, said fastener is then inserted through said first and second tubes.

6. The safety guard for door gaps of claim 5 wherein:

said top bushing includes a top flange extending outward from an outer perimeter at a top thereof.

7. The safety guard for door gaps of claim 5 wherein:

said bottom bushing includes a bottom flange extending outward from an outer perimeter at a bottom thereof.

8. The safety guard for door gaps of claim 5 wherein:

a plate slit is formed in an end of said top hinge tube to receive a thickness of a hinge plate of said top hinge.

9. A safety guard for door gaps, comprising:

a safety tube which includes a length that is the same as a distance between a bottom of top hinge plates of a top hinge and a top of bottom hinge plates of a bottom hinge;

an extended length hinge pin, wherein a hinge pin of the top hinge is removed and replaced with said extended length hinge pin, said extended length hinge pin extends past a bottom of the top hinge plates of the top hinge;

a top bushing is retained in a top of said safety tube, said top bushing includes a pin bore to receive said extended length hinge pin; and a bottom pin bushing is retained in a bottom of said safety tube, said bottom pin bushing includes an inner diameter which is sized to receive a head of a hinge pin of the bottom hinge.

10. The safety guard for door gaps of claim 9 wherein:

said top bushing includes a top flange extending outward from an outer perimeter at a top thereof.

11. The safety guard for door gaps of claim 9 wherein:

said bottom bushing includes a bottom flange extending outward from an outer perimeter at a bottom thereof.

* * * * *